US007370585B2

(12) United States Patent
White et al.

(10) Patent No.: US 7,370,585 B2
(45) Date of Patent: May 13, 2008

(54) EXPLOSIVES LINER

(75) Inventors: Christopher White, Glascoed, Usk, Gwent (GB); Geoffrey Bennett, Glascoed, Usk, Gwent (GB); Daniel Wayne Thomas, Glascoed, Usk, Gwent (GB); Gavin Michael Crimmings, Glascoed, Usk, Gwent (GB); David Conway Johnson, Glascoed, Usk, Gwent (GB)

(73) Assignee: BAE Systems plc, London (GB)

( * ) Notice: Subject to any disclaimer, the term of this patent is extended or adjusted under 35 U.S.C. 154(b) by 234 days.

(21) Appl. No.: 10/507,174

(22) PCT Filed: Mar. 6, 2003

(86) PCT No.: PCT/GB03/00952

§ 371 (c)(1),
(2), (4) Date: Sep. 10, 2004

(87) PCT Pub. No.: WO03/078919

PCT Pub. Date: Sep. 25, 2003

(65) Prior Publication Data

US 2005/0183611 A1 Aug. 25, 2005

(30) Foreign Application Priority Data

Mar. 11, 2002 (GB) ..... 0205565.5

(51) Int. Cl.
*F42B 33/02* (2006.01)
*F42B 12/20* (2006.01)

(52) U.S. Cl. ..... 102/282; 86/31

(58) Field of Classification Search ..... 102/282, 102/473, 382, 482, 512, 513; 86/31, 23, 86/29, 20.1
See application file for complete search history.

(56) References Cited

U.S. PATENT DOCUMENTS

| | | | | |
|---|---|---|---|---|
| 2,056,098 | A | 9/1936 | Gavlak | |
| 2,373,883 | A | 4/1945 | Ferrel | |
| 2,434,452 | A | 1/1948 | Barber | |
| 3,646,844 | A | 3/1972 | Clay | |
| 4,147,108 | A * | 4/1979 | Gore et al. | 102/494 |
| 4,503,994 | A * | 3/1985 | Pyle | 222/64 |
| 5,014,623 | A | 5/1991 | Walker et al. | |
| 5,054,399 | A * | 10/1991 | Bilek et al. | 102/481 |
| 5,062,343 | A * | 11/1991 | Sjoberg | 86/20.1 |
| 5,353,709 | A | 10/1994 | Eller et al. | |
| 5,939,662 | A * | 8/1999 | Bootes et al. | 102/473 |
| 7,114,449 | B2 * | 10/2006 | Altenau | 102/473 |

FOREIGN PATENT DOCUMENTS

| | | |
|---|---|---|
| DE | 37 03 629 A | 8/1988 |
| EP | 0 401 184 A1 | 5/1990 |
| GB | 1 321 786 | 2/1972 |
| GB | 1 439 450 A | 6/1976 |
| GB | 2 154 717 A | 9/1985 |
| WO | WO 89/12211 | 12/1989 |

* cited by examiner

*Primary Examiner*—James S Bergin
(74) *Attorney, Agent, or Firm*—Crowell & Moring LLP

(57) ABSTRACT

Described herein is a method of filling ordnance with explosive materials. An ordnance shell (2) comprises a cavity (32) filled with explosive material (10), the explosive material (10) being contained in a bag (36) located within the cavity (32).

1 Claim, 2 Drawing Sheets

EXPLOSIVES LINER

Figure 1:
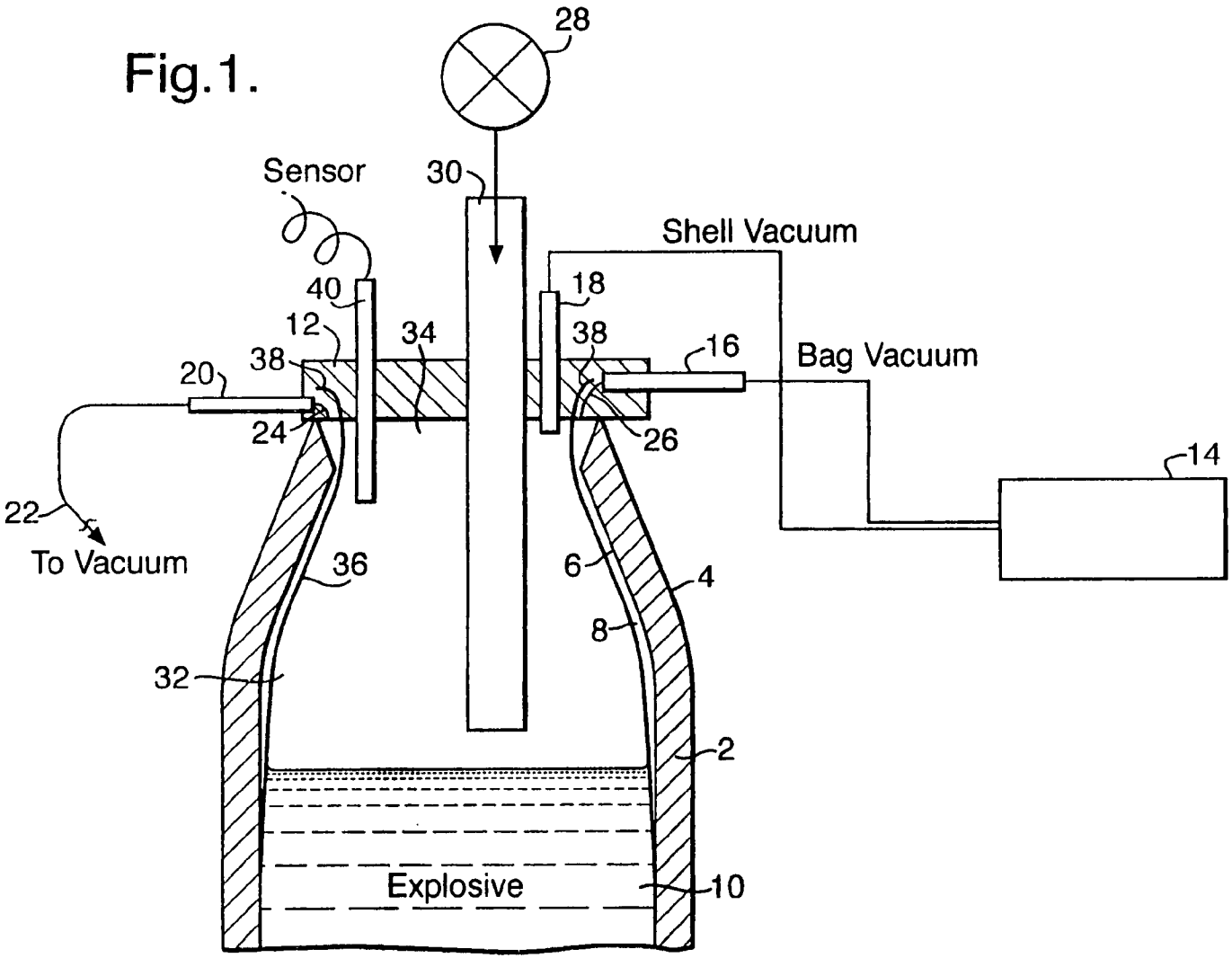

This invention relates to the field of the filling of ordnance with explosive materials.

Traditional methods used for filling ordnance with polymer bonded explosive (PBX) utilise a filling process based on the combination of usually two materials (an explosive mixture (pre-mix) and a hardener). The two materials are mixed together and injected into the volume reserved for explosive materials usually at the tip of the ordnance.

In a typical application of the mixing and filling process, a pre-mix of explosive is produced and typically mixed with a hardener (i.e. IPDI) the mixture mixed together to produce a combined final explosive material (e.g. PBX).

Ordnance to be filled is typically placed in a vacuum chamber and a filling attachment from the bottom outlet valve of the mixer bowl containing the fully mixed PBX composition is attached to the chamber. Typically, the vacuum chamber will be evacuated to <100 millibars.

The vacuum provides the physical motivation for the fully combined final explosive material to flow into the ordnance. However, the interaction of the combined final explosive material and the inner surface of the volume to be filled can lead to problems in terms of the inadvertent adhesion of the material to the sides of the volume during filling. This introduces the possibility of an imperfect fill of the explosive cavity. An imperfect fill of explosives may result in ordnance failing safety acceptance tests, the ordnance being liable to early detonation due to the movement of explosive material within the ordnance as it is launched.

In addition to the problems associated with the issue of imperfect fill, ordnance can be subject to environmental cycling, including temperature cycling, which can cause the explosive material contained within the ordnance to lose some of its required physical characteristics.

The problems associated with imperfect fill and environmental cycling are known in the art and attempts to solve these problems have been made by the use of approaches, such as liners which are sprayed or poured onto the inner surface of the explosives cavity or volume within the ordnance. This liner would in turn adhere to the wall of the explosives volume in an attempt to reduce the effects of explosive adhesion and environmental cycling.

However, the problems associated with the state of the art solutions relate to the fact that the liner does indeed adhere to the wall of the explosives volume, and consequently the explosive filling thereby suffers from some of the effects induced by environmental/temperature cycling and physical vibration that would have also been observed had no liner been present.

Additionally, when ordnance is required to be disposed of at the end of its service life explosive materials comprising PBX cannot be effectively 'boiled out' as in the case of TNT based explosives, and an expensive decommissioning process has to be put in place requiring the effective cutting in two or more parts of the ordnance, to allow for the extraction of the PBX explosives which will have adhered to the inner wall of the explosive volume.

The invention described herein provides for apparatus and a method for reducing the problems associated with the filling of explosives, especially in the case of explosives comprising PBX materials and the like, and for drastically reducing the effects of environmental and temperature cycling on the physical quality of the explosive filling.

Additionally the invention described herein provides for an improved method of decommissioning ordnance containing PBX based explosives and the like.

Accordingly there is provided ordnance comprising a cavity filled with explosive material, said explosive material being contained in a bag within said cavity.

In a first preferred embodiment of the invention the bag is made of an elastomeric material.

Preferably said elastomeric bag will have a volume less that of the explosives cavity of said ordnance.

In a further preferred embodiment of the invention the elastomeric bag will have a volume in the range 5% to 10% less than that of the explosives cavity of said ordnance.

Additionally there is provided a method of filling ordnance with explosive materials, comprising the use of a bag in accordance with another aspect of the invention, said bag being inserted into the explosives cavity of said ordnance (see for example FIG. 2), said bag then being filled with explosive materials (see for example FIG. 1).

In a further preferred embodiment of the invention a bag in accordance with the invention is forced against the walls of said explosives volume by the action of a vacuum source.

The invention is now described by way of example only with reference to the following drawing, in which FIG. 1 is a diagrammatic representation of an explosives filling bag and ordnance filling apparatus in accordance with the invention.

FIG. 1 shows a top section of an ordnance shell 2 being filled with explosive material 10, the ordnance having both an outer surface 4 and an inner surface 6, the inner surface describing a cavity 32 for housing explosive material 10.

Figure 2:
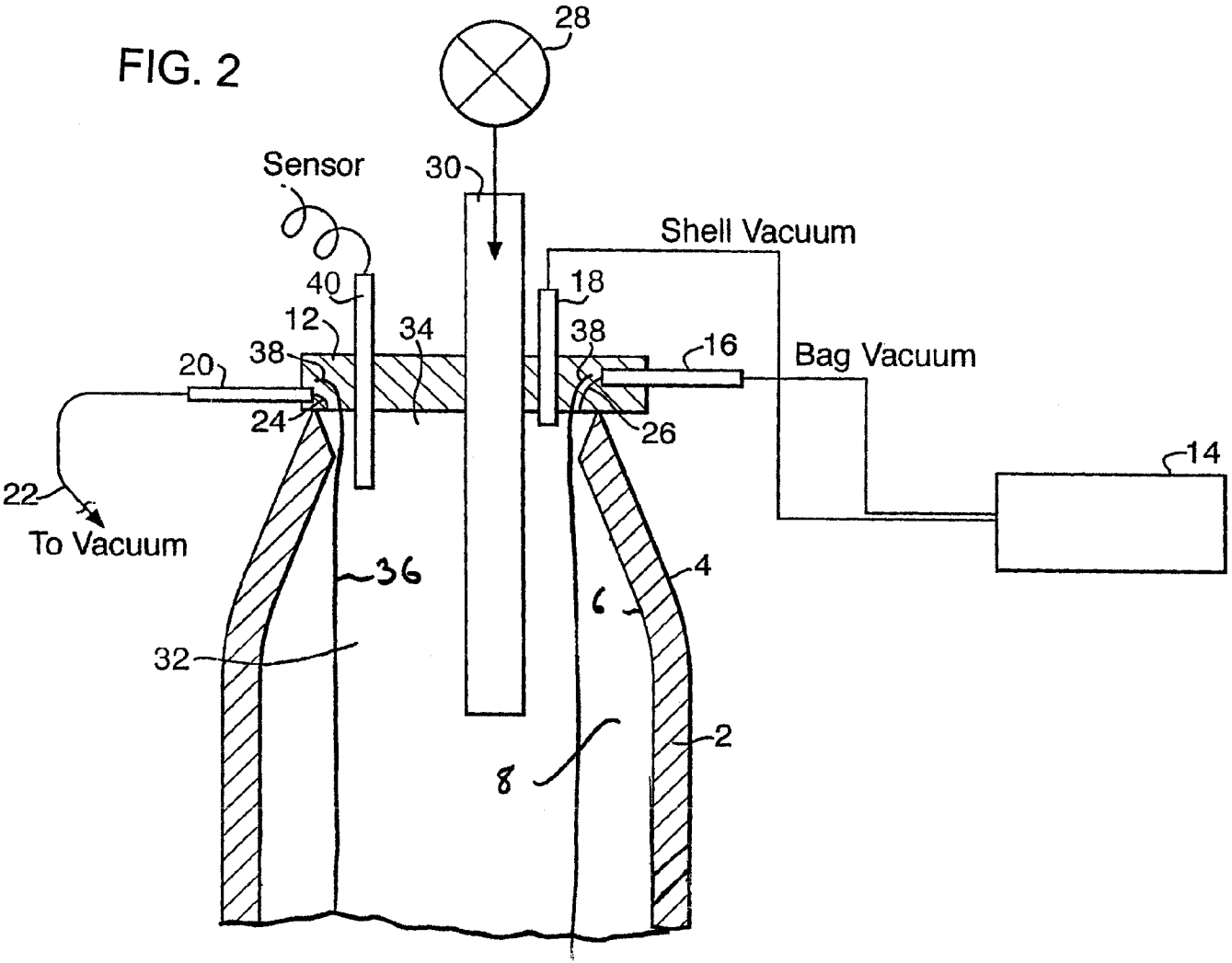

FIG. 2 shows a top section of an ordnance shell 2 prior to filling with explosive material 10, the ordnance having both an outer surface 4 and an inner surface 6, the inner surface described a cavity 32 for housing explosive material 10. The difference in volume between the cavity 32 and the bag 36 has been exaggerated.

Explosive material 10 enters the cavity 32 via a filling tube 30, the flow of the explosive material into the cavity 32 being controlled by a valve 28.

A vacuum filling attachment 12 is secured over the aperture 34 describing the opening in the cavity 32 such that a substantially airtight seal is produced between the atmosphere and the volume within the cavity 32. Vacuum means 14 is provided, the vacuum means 14 being connected to the filling attachment 12 such that any gas such as air within the cavity 32 can be partially or wholly evacuated by the action of the vacuum port 18 thereby providing a motivating force for explosive material to flow through the valve 28 when opened, down the filling tube 30 and into the cavity 32.

Additional vacuum ports 16 and 20 are also shown, the vacuum line shown at 22 shown stopped for illustrative purposes only but actually returning to the vacuum source 14.

An elastomeric bag 36 is shown held within the cavity 32 of the ordnance shell 2 by the vacuum filling attachment 12. The main vacuum ports 16 and 20 have corresponding smaller ports to enable a vacuum to be created within the space 8 defined by the bag 36 and the inner wall 6 of the cavity 32. The action of this vacuum in extracting gas such as air from within the cavity 8 provides the force required to hold the bag 36 against the inner wall 6 of the cavity 32 thereby providing a bag lined cavity 32 into which the explosive material 10 can be injected.

The elastomeric bag 36 is between 5% and 10% smaller than the shell cavity 32 to ensure that the explosive material (filling) 10 does not adhere to the inner wall 6 of the ordnance shell 2. The bag 36 also ensures that the filling 10 survives environmental changes without cracking. The bag

36 provides a barrier between the filling 10 and the ordnance shell 2 which stretches and shrinks with the filling 10.

In order to maintain contact between the bag 36 and the inner wall 6 in the presence of the vacuum force generated within the cavity 32 by the vacuum port 18, there must be a differential in the two vacuums produced in favour of the bag vacuum.

FIG. 1 shows a non-contact level sensor 40 present within the cavity 32, the sensor 40 providing a method of sensing the fill volume of the explosive 10 within the cavity 32. The output from the sensor 40 can be fed back to a control means for effecting the action of the valve 28 and indeed aspects of the explosives process not shown. The sensor 40 therefore controls the filling height of the explosive material as a non-contact fill-to-level device.

The non-contact level sensor 40 may comprise an optical sensor, a fibre optic sensor, a laser or an LED.

The decommissioning of ordnance comprising a bag in accordance with the invention is simplified over the now prior art. The bag can be manufactured with an anti-adhesion surface to prevent adhesion between the bag and the inner lining of the cavity. Alternatively, the cavity lining itself can be treated with an anti-adhesion material prior to introducing the bag. When subsequently decommissioning the ordnance, the bag containing the explosives can be removed as a whole (if the ordnance design allows) thereby reducing the exposure of the person decommissioning the ordnance to the explosive material. Where the ordnance design does not allow removal of the bag containing the explosives as a whole (e.g. in the case of artillery shell) then a single transverse cut across the major internal diameter of the ordnance should allow the bag containing the explosives to be easily removed in two parts.

The other advantages of the invention will be readily apparent to those skilled in the art and the substitution of elements for mechanical equivalents and adaptation of the process using different materials and the like should be construed as being comprised within the inventive concept as claimed.

References to ordnance in the above specification and claims shall be construed as non-limiting and in respect of the invention shall include without limitation shells, mortars, rockets, bombs, warheads, projectiles and any other weapons or containers which are required to be filled with a combined explosive mixture.

The invention claimed is:

1. Ordnance comprising an inner wall defining a cavity, said cavity filled with explosives material, said explosives material being contained in an elastomeric bag within said cavity, wherein, in an unstretched state, said bag has a volume that is smaller than that of the explosives cavity of said ordnance, wherein, in said unstretched state, the bag has a volume in a range 5% to 10% less than that of the explosives cavity of said ordnance.

* * * * *